US006003459A

United States Patent [19]

Nielsen

[11] Patent Number: 6,003,459

[45] Date of Patent: Dec. 21, 1999

[54] TRANSPORT SHIP

[75] Inventor: Jens M. Nielsen, Dragør, Denmark

[73] Assignee: IMA International Maritime Advisers, Copenhagen, Denmark

[21] Appl. No.: 08/988,673

[22] Filed: Dec. 11, 1997

[30] Foreign Application Priority Data

Dec. 3, 1997 [DK] Denmark ..... 1395/97

[51] Int. Cl.[6] ..... B63B 11/02

[52] U.S. Cl. ..... 114/72

[58] Field of Search ..... 114/72, 74 R, 114/74 A

[56] References Cited

U.S. PATENT DOCUMENTS 4,082,051 4/1978 Timmann ..... 114/72

FOREIGN PATENT DOCUMENTS 0601233 6/1994 European Pat. Off. .
4225790 2/1994 Germany .
2081023 6/1997 Russian Federation .

*Primary Examiner*—Jesus D. Sotelo
*Attorney, Agent, or Firm*—Watson Cole Grindle Watson, PLLC

[57] ABSTRACT

A transport ship (20) having a hull includes a sheathing (22), a weather deck (23, 23') and a hold (28, 28', 30), and having a front part (35), a rear part (25) and a central part (29). The ship is unique in that the front part (35) of the ship includes a hold section (28') defined by the hull and the weather deck (23'), and access hatches provided in the weather deck (23') to give access to the hold section (28'), that the rear part (25) of the ship includes a hold section (28) defined by the hull and the weather deck (23), and access hatches provided in the weather deck (23) to give access to the hold section (28), that the central part (29) of the ship includes a refrigerated hold section (30) defined by an upper thermally insulated refrigerated hold deck (130), a thermally insulated bottom and by thermally insulated walls (132, 133 . . . ) extending in the transverse direction and longitudinal direction of the ship, and in that the weather deck (23, 23') is adapted to support a cargo.

37 Claims, 1 Drawing Sheet

TRANSPORT SHIP

BACKGROUND OF THE INVENTION

1. Field of the Invention

The present invention relates to a transport ship having a hull includes a sheathing and a weather deck and having a front part, a rear part and a central part.

2. The Prior Art

A large number of different types of transport ships of the above-mentioned general kind are known in practice. Usually, the rear part of the ship includes a deck superstructure with the navigating bridge of the ship and the means necessary for the propulsion of the ship, including machinery and fuel tanks, while the front part of the ship includes the stem and store rooms, if any. The central part of the ship includes the hold, which is constructed in accordance with the specific type of goods to be transported. The hold may thus be constructed specifically for the transport of one specific type of goods, including e.g., cooled goods, liquid gas, dry cargo, oil or containers. Particularly in former times, the possibilities of utilizing transport ships for carrying combinations of the above-mentioned types of goods were very limited.

To achieve an increased flexibility of goods transport ships to a certain degree, the so-called Ro-Ro ships have been developed in the past twenty years, with a weather deck for the transport of particularly containers and with a plurality of tween decks that may be used for the transport of trailers or e.g., cars which may be loaded using stern ramps.

However, as far as the so-called refrigerator ships are concerned, specifically adapted to transport refrigerated goods, it has not been possible to achieve optimum flexibility and capacity in the past. In particular, the conventional structure of the refrigerator ships and stability deliberations have set a limit to the amounts of additional types of goods that can be carried and to the conditions under which such goods may be carried. Refrigerator ships are typically provided with an internal refrigerated hold over the greater part of the length of the hull, see e.g., European Patent Application No. 0 601 233, the refrigerated hold accommodating a relatively large number of tween decks with a small free height. The reason is that the goods are usually stored on pallets and do not stand stacking in the height. The goods may e.g. be bananas, lemons or vegetables which are to be kept refrigerated during the transport. The goods are typically cargoes which are to be transported over great distances, e.g. from South America to Europe.

In view of the above, it has been attempted to construct the refrigerator ships so as to enable them to carry standard containers which are stacked on the weather deck of the ship. This results in some increased flexibility, as the ship can then be utilized for the transport of refrigerated goods as well as a surface cargo, which may produce increased earnings per voyage. These refrigerator ships, however, are inexpedient, because certain loading situations give rise to stability problems during the voyage of the ship. These problems may occur when the ship, when bound for return, is to sail without refrigerated goods, but with a surface cargo, such as containers. Since the typical surface cargoes are formed by containers of a much greater weight than a corresponding volume of the refrigerated goods, stability deliberations set a limit to how high the containers may be stacked on the weather deck, also when sailing with refrigerated goods.

An object of the present invention is to provide an improved transport ship by means of which, with fewer stability problems, different combinations of goods may be transported, at least one type of which should preferably be capable of being transported in refrigerated form, while allowing greater amounts of the other goods to be transported at the same time. In this connection, different combinations of goods are taken to mean sailing with or without the refrigerated goods, and it must also be possible optionally to transport at least one other type of goods, particularly in the form of standard containers. This provides a high degree of flexibility, so that the owner of the ship can obtain greater earnings per voyage in relation to the known refrigerator ships.

SUMMARY OF THE INVENTION

This object is achieved according to the invention in that the front part of the ship includes a hold section defined by the hull and the weather deck, and access hatches provided in the weather deck to give access to the hold section, that the rear part of the ship includes a hold section defined by the hull and the weather deck, and access hatches provided in the weather deck to give access to the hold section, that the central part of the ship includes a refrigerated hold section defined by an upper, thermally insulated refrigerated hold deck, a thermally insulated bottom and by thermally insulated walls extending in the transverse direction and longitudinal direction of the ship, and in that the weather deck is adapted to support a cargo.

When the ship is constructed in this manner, it will also be possible to sail without goods in the refrigerated hold, as the rest of the goods may be stowed relatively low against the keel on each side of the refrigerated hold section in the longitudinal direction of the ship. A favourable metacentre height may hereby be maintained, as only the draught of the ship will change. Since, in conventional refrigerator ships, the rest of the goods must necessarily be carried on the weather deck to avoid damage to the insulated walls, the metacentre height in these ships is very unfavourable when sailing without refrigerated goods in the hold.

According to a particularly preferred embodiment, the upper refrigerated hold deck is arranged at a height above the weather deck of between 20% and 200%, preferably between 50% and 150%, of the moulded depth of the ship measured to the weather deck. In this case, the moulded depth is measured from the base line of the ship. It is hereby possible to achieve approximately the same loading volume for refrigerated goods as in a traditional refrigerator ship of approximately the same length, and the refrigerated hold section is easy to insulate thermally. Further, the sunlit surface of the refrigerated hold section will be reduced compared with a traditional refrigerator ship when sailing without surface cargo. In the traditional refrigerator ships, the energy of the sun impinges on the entire weather deck which defines the upper boundary of the refrigerated hold approximately in the entire length of the ship. This will also allow the necessary cooling energy to be reduced. If necessary, the width of the ship may also be slightly greater than that of the traditional refrigerator ship.

It is moreover preferred that the insulated walls extending in the transverse direction directly adjoin the hold section in the front and/or rear part of the ship, and that, optionally, the thermally insulated walls extending in the longitudinal direction also adjoin the sheathing of the hull. This results in optimum utilization of the ship, as the natural walls are utilized for defining the various holds. It is particularly preferred that the upper refrigerated hold deck is adapted to support a cargo, and that the navigating bridge of the ship and the premises of the crew are provided on the upper refrigerated hold deck. All horizontal faces may hereby be utilized for supporting the other type of goods, particularly containers. When the navigating bridge is simultaneously arranged amidships, it is possible to arrange an even very high stack of containers on the weather deck, as the current maritime rules on the mate's line of sight to the horizon are still observed.

It is also preferred that the refrigerated hold section is provided with tween decks, and that the distance between the decks is about 2 m–3 m, preferably about 2.25 m–about 2.5 m. This allows transporting of palleted goods with an optimum utilization of the load volume, as waste of space between the upper side of the pallets arid the under side of the tween decks is greatly reduced. Furthermore, like in conventional refrigerator ships, the tween decks may advantageously be constructed as a grating, so that cooling takes place by means of circulating air.

When, according to a particularly expedient embodiment, the access to the refrigerated hold section is provided in the thermally insulated walls, preferably in the longitudinal walls, it is possible to load and unload the refrigerated goods and the surface cargo at the same time.

Further, the length of the refrigerated hold section may advantageously constitute between about 20% and 50%, preferably between about 25% and 45%, of the total length of the ship. Hereby, the longitudinal walls of the refrigerated hold section will, to a great extent, be disposed solely within the area of the hull where the sheathing is almost plane, which simplifies the construction of the insulation of the walls.

To obtain relatively symmetrical loading conditions to ensure a favourable stability as regards the trim moment of the ship, it is preferred that the thermally insulating walls defining the refrigerated hold section extend symmetrically about the midship section and the middle-line plane of the ship.

Finally, it is preferred that access hatches to the hold sections are provided substantially in the entire width of the hold sections. The hold sections in the front and rear parts of the ship may thus be filled and emptied basically in the same manner as in the conventional container ships.

The invention will be explained more fully below with reference to the preferred embodiment shown in the drawings. In the drawing:

DETAILED DESCRIPTION OF THE PREFERRED EMBODIMENT

Figure 1:
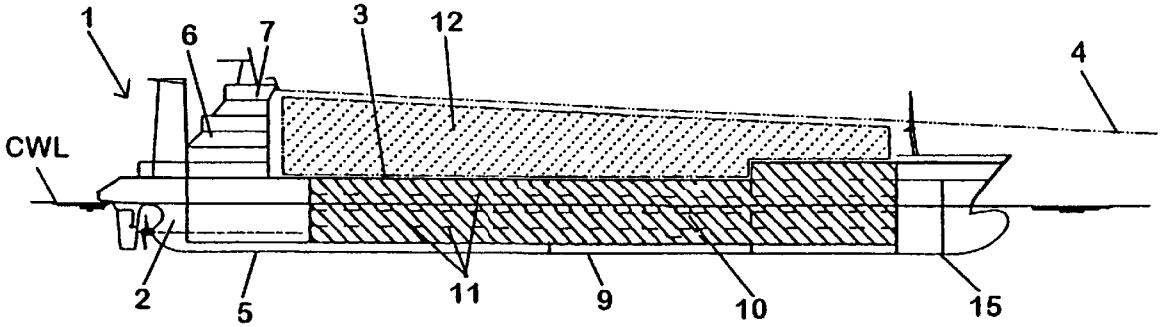
FIG. 1 PRIOR ART
FIG. 1 shows an example of a known type of a refrigerator ship, seen in partial vertical longitudinal section.

FIG. 1 shows an example of a known refrigerator ship 1 having a hull including a sheathing 2, a weather deck 3 and a hold 10. The refrigerator ship 1 has a rear part 5 including the machinery necessary for the propulsion of the ship and a deck superstructure including premises 6 for the crew and a navigating bridge 7. In addition, the ship 1 includes a front part 15 with the stem and bulb of the ship, and a central part 9 with a refrigerated hold 10. The refrigerated hold 10 is defined by thermally insulated walls and a thermally insulated bottom, and also the superjacent weather deck 3 is thermally insulated above the refrigerated hold 10.

The refrigerated hold 10 additionally includes a plurality of tween decks 11, which are indicated in dashed line, and which may be constructed as a grating, the free height between the tween decks being typically about 2.25 m. This free height is selected in accordance with the height of a standard pallet of refrigerated goods, e.g. bananas, and the tween decks 11 are usually also constructed to allow driving with a fork-lift truck. In the example shown, the ship 1 includes four tween decks 11, and the height of the ship 1 from the base line to the weather deck is selected so that the desired number of tween decks may be provided. Loading and unloading of the refrigerated hold 10 may take place using elevators or cranes, by means of which the refrigerated goods, indicated in hatched line, may be carried from each tween deck 11 to an access door provided in the side of the ship at a level above the waterline CWL, or optionally to hatches on the weather deck.

The weather deck 3, which forms the closure of the hull upwardly, also serves to support a surface cargo 12, which is indicated in dotted line in the drawing, and which will normally consist of containers stacked on top of each other and Lashed to the weather deck 3. The stacking height of the containers 12 will usually be limited partly with a view to the stability of the ship against heeling and partly by international maritime rules, according to which the line of sight 4 from the navigating bridge must reach the surface of the sea at a distance from the stem corresponding to the length of the ship.

The shown conventional refrigerated ship may thus be used for carrying refrigerated goods as well as containers. However, it is clear that the stability of the ship will be affected considerably if the refrigerated hold 10 is empty and only containers on the weather deck 3 are to be carried. This will typically be the case for a return voyage. To compensate for this load situation, ballast tanks, into which sea water is pumped, will normally be incorporated, in many cases up to 30% of the loading capacity of the ship. These tanks, however, take up space at the bottom of the hull that might be used for goods.

The possible stacking height of the containers on the weather deck 3, however, is limited also in the situation where refrigerated goods are transported in the refrigerated hold. The reason is that, in practice, the weight per volume unit of the refrigerated goods, which will typically be bananas, is considerably smaller than the weight per volume unit of the cargo on the weather deck. It is therefore just possible to carry a relatively small number of containers, which must be stacked very low on the weather deck 3.

Seen from an economic point of view, this situation is undesirable of course, as it reduces the earnings of the shipowner unnecessarily.

Figure 2:
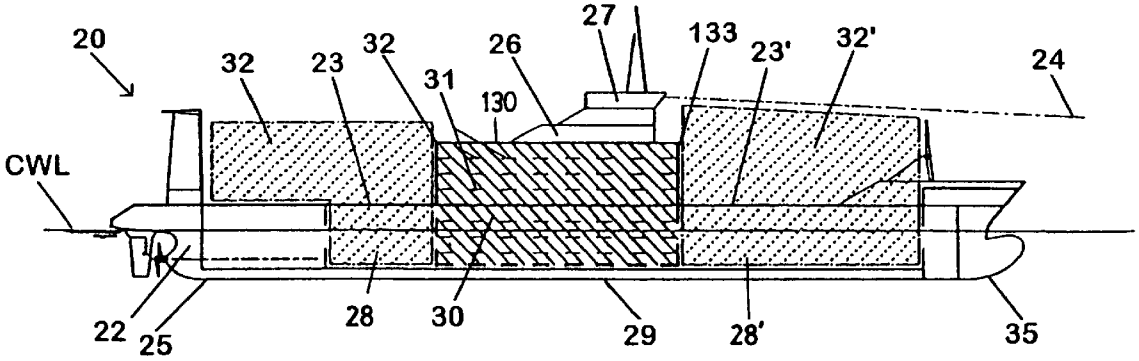
FIG. 2 shows a preferred embodiment of a refrigerator ship according to the invention, seen in partial vertical longitudinal section.

FIG. 2 shows a vertical longitudinal section through a transport ship 20 according to the invention. The shown transport ship 20, like the conventional transport ship, includes a hull having a sheathing 22, a weather deck 23, 23' and a hold. The hold is divided into three hold sections, and the rear part 25 of the ship includes the machinery of the ship and a rear hold section 28. The front part 35 of the ship 20 includes the stem of the ship and a front hold section 28'. Both the front and rear hold sections 28, 28' are defined upwardly by a respective part 23, 23' of the weather deck, which is formed with access hatches giving access to the hold sections for vertical lowering of goods, in particular containers. To permit lowering of the containers, the hatches are preferably provided in the entire width of the hold sections like in conventional container ships, and the hatch covers are constructed to support the surface cargo. Moreover, the front part 23' and the rear part 23 of the weather deck are preferably at the same level above the base line as the weather deck 3 in the conventional refrigerator ship 1.

The ship 20 additionally includes a central part 29 having a refrigerated hold section 30, and the extent of the refrigerated hold section 30 in the fore-and-aft direction of the ship preferably constitutes about 25%–40% of the total length of the ship. The width of the refrigerated hold 30 may preferably correspond to the width of the ship. The refrigerated hold section 30 is intended to transport refrigerated goods, such as bananas or similar food products, or alternatively to transport cooled, liquid gas, and is defined upwardly by a thermally insulated refrigerated hold deck 130. The refrigerated hold section 30 additionally has a thermally insulated bottom and thermally insulated longitudinal and transverse walls 132, 133, and the front part 23' and the rear part 23 of the weather deck adjoin the transverse walls 132, 133, as shown. The transverse walls 132, 133 moreover preferably form a transverse boundary of the front and rear hold sections 28, 28'. The refrigerated hold deck 130 is preferably adapted to support a deck superstructure with the navigating bridge 27 of the ship 20 and optionally a surface cargo in the form of a minor stack of containers lashed to the refrigerated hold deck 130.

Like the conventional refrigerated holds, the refrigerated hold section 30 is provided with a plurality of fixed tween decks 31, e.g. in the form off a grating, to which access may be had via an access door (not shown) in the side of the ship and using elevators, and, if necessary, partitions may be provided, dividing the refrigerated hold section 30 into smaller sections in which different temperatures, e.g. above the freezing point and below the freezing point, may be maintained. The distance between the tween decks 31 is determined by the height of a standard pallet and is therefore typically about 2.25 m, like in the conventional refrigerator ships.

In the embodiment shown in FIG. 2, the refrigerated hold deck 130 is arranged at a height above the weather deck 23' of about 100% of the moulded depth of the ship measured to the main deck 23' from the base line, which means that the refrigerated hold section 30 comprises a total of eight tween decks, four of which are below the level of the weather deck 23, 23'. It will thus be possible to stack refrigerated goods at a greater height than in the conventional refrigerator ships. When comparing with the conventional refrigerator ship 1 of a corresponding length shown in FIG. 1, it will be clear that selection of a suitable height of the refrigerated hold deck 130 will provide the same loading capacity for refrigerated goods.

FIG. 2 moreover shows a situation in which the ship 20 is fully loaded with refrigerated goods (indicated in hatched line) in the refrigerated hold section 30 and with a plurality of containers 32, 32' (indicated in dotted line) stacked on top of each other in the hold sections 28, 28' and on the weather deck 23, 23'. As the weight per volume unit of the refrigerated goods is typically smaller than for the containers, as mentioned before, the possibility of stacking containers near the keel will mean that the total centre of gravity of the cargo is relatively low in relation to a conventional refrigerator ship of a corresponding length and loaded with the same number of containers. It is hereby possible to stack a larger number of containers on top of each other with approximately the same stability conditions as in the conventional refrigerator ship. In the situation of sailing without refrigerated goods, it may moreover be possible to reduce the size of the water ballast in some embodiments.

Table 1 below serves to illustrate some of the advantages of the invention. In the table, the capacity of a ship according to the invention constructed with a length of 150 meters and with a refrigerated hold with a length of about 50 meters, a width corresponding approximately to the width of the ship (about 25 m) and with eight tween decks (FIG. 2) is compared with a conventional refrigerator ship with the same length as shown in FIG. 1. The building costs for both ships will typically amount to DKK 220 million (1997). For both vessels, the distance between the base line and the weather deck will be about 13.3 m and the width will approximately be the same.

TABLE 1

| CARGO | THE INVENTION | CONVENTIONAL SHIP |
|---|---|---|
| A Bananas | 5000 tons | 5000 tons |
| B Bananas | 5000 tons | 5000 tons |
| Other cargo | max. 600 containers | max. 150 containers |
| C Bananas | 0 | 0 |
| Other cargo | max. 600 containers | max. 150 containers |

It should be added that the rear weather deck 23 may very well be arranged at a lower level than the front weather deck 23', and then the first-mentioned part of the vessel does not have to be shielded against the waves to the same high extent. In this situation, the position of the refrigerated hold deck 130 relative to the weather deck may then be determined on the basis of the level of the front weather deck 23'.

I claim:

1. A transport ship (20) for transporting at least a first cargo and a refrigerated cargo and having a hull comprising a sheathing (22), a weather deck (23, 23') and a hold (28, 28', 30), and having a front part (35), a rear part (25) and a central part (29), wherein the front part (35) of the ship comprises a hold section (28') defined by the hull and the weather deck (23'), and access hatches provided in the weather deck (23') to give access to said hold section (28), the rear part (25) of the ship comprises a hold section (28) defined by the hull and the weather deck (23), and access hatches provided in the weather deck (23) to give access to said hold section (28), the central part (29) of the ship comprises a refrigerated hold section (30) for receiving said refrigerated cargo and being defined by an upper thermally insulated deck (130), a thermally insulated bottom and by thermally insulated walls (132, 133) extending in the transverse direction and longitudinal direction of the ship, said weather deck with said hatches in said front part and said rear part are adapted to support a cargo, and said hold sections (28, 28') of said front part (35) and said rear part (25) are adapted for receiving said first cargo.

2. A transport ship according to claim 1, wherein said upper insulated deck (130) is provided at a height above the weather deck (23, 23') of between 20% and 200% of the moulded depth of the ship (20) measured to the weather deck (23, 23').

3. A transport ship according to claim 2, wherein said height is between 50% and 150% of said moulded depth.

4. A transport ship according to claim 1, wherein the insulated walls (132, 133) extending in the transverse direction directly adjoin the hold section (28, 28') in the front and rear part (25, 35) of the ship.

5. A transport ship according to claim 1, wherein the thermally insulated walls extending in the longitudinal direction adjoin the sheathing (22) of the hull.

6. A transport ship according to claim 1, wherein said upper deck (130) is adapted to support a cargo.

7. A transport ship according to claim 1, wherein the navigating bridge (27) of the ship and the premises (26) of the crew are provided on said upper deck (130).

8. A transport ship according to claim 1, wherein the refrigerated hold section (30) is provided with tween decks (31), and the distance between the tween decks is about 2 m–3 m.

9. A transport ship according to claim 8, wherein the tween decks (31) are constructed as a grating, and the cooling takes place by means of circulating air.

10. A transport ship according to claim 1, wherein the access to the refrigerated hold section (30) is provided in the thermally insulated walls.

11. A transport ship according to claim 1, wherein the length of the refrigerated hold section (30) constitutes between about 20% and 50% of the total length of the ship.

12. A transport ship according to claim 1, wherein the thermally insulated walls (132, 133) of the refrigerated hold section (30) are arranged symmetrically about the midship section and the middle-line plane.

13. A transport ship according to claim 1, wherein said access hatches to the hold sections (28, 28') are provided substantially in the entire width of the hold sections (28, 28').

14. A transport ship having a hull comprising a sheathing (22), a weather deck (23, 23') and a hold (28, 28', 30), and having a front part (35), a rear part (25) and a central part (29), wherein the front part (35) of the ship comprises a hold section (28') defined by the hull and the weather deck (23'), and access hatches provided in the weather deck (23') to give access to said hold section (28'), the rear part (25) of the ship comprises a hold section (28) defined by the hull and the weather deck (23), and access hatches provided in the weather deck (23) to give access to said hold section (28), the central part (29) of the ship comprises a refrigerated hold section (30) defined by an upper thermally insulated deck (130), a thermally insulated bottom and by thermally insulated walls (132, 133) extending in the transverse direction and longitudinal direction of the ship, the weather deck (23, 23') is adapted to support a cargo, and said upper deck (130) is provided at a height above the weather deck (23, 23') of between 20% and 200% of the moulded depth of the ship (20) measured to the weather deck (23, 23').

15. A transport ship according to claim 14, wherein said height is between 50% and 150% of said moulded depth.

16. A transport ship according to claim 14, wherein the insulated walls (132, 133) extending in the transverse direction directly adjoin the hold section (28, 28') in the front and rear part (25, 35) of the ship.

17. A transport ship according to claim 14, wherein the thermally insulated walls extending in the longitudinal direction adjoin the sheathing (22) of the hull.

18. A transport ship according to claim 14, wherein said upper deck (130) is adapted to support a cargo.

19. A transport ship according to claim 14, wherein the navigating bridge (27) of the ship and the premises (26) of the crew are provided on said upper deck (130).

20. A transport ship according to claim 14, wherein the refrigerated hold section (30) is provided with tween decks (31), and the distance between the tween decks is about 2 m–3 m.

21. A transport ship according to claim 20, wherein the tween decks (31) are constructed as a grating, and the cooling takes place by means of circulating air.

22. A transport ship according to claim 14, wherein the access to the refrigerated hold section (30) is provided in the thermally insulated walls.

23. A transport ship according to claim 14, wherein the length of the refrigerated hold section (30) constitutes between about 20% and 50% of the total length of the ship.

24. A transport ship according to claim 14, wherein the thermally insulated walls (132, 133) of the refrigerated hold section (30) are arranged symmetrically about the midship section and the middle-line plane.

25. A transport ship according to claim 14, wherein said access hatches to the hold sections (28, 28') are provided substantially in the entire width of the hold sections (28, 28').

26. A transport ship having a hull comprising a sheathing (22), a weather deck (23, 23') and a hold (28, 28', 30), and having a front part (35), a rear part (25) and a central part (29), wherein the front part (35) of the ship comprises a hold section (28') defined by the hull and the weather deck (23'), and access hatches provided in the weather deck (23') to give access to said hold section (28'), the rear part (25) of the ship comprises a hold section (28) defined by the hull and the weather deck (23), and access hatches provided in the weather deck (23) to give access to said hold section (28), the central part (29) of the ship comprises a refrigerated hold section (30) defined by an upper thermally insulated deck (230), a thermally insulated bottom and by thermally insulated walls (132, 133) extending in the transverse direction and longitudinal direction of the ship, and the weather deck (23, 23') is adapted to support a cargo, the length of said refrigerated hold section (30) constituting between about 20% and 50% of the total length of the ship.

27. A transport ship according to claim 26, wherein the length of the refrigerated hold section (30) constitutes between about 25% and 45% of the total length of the ship.

28. A transport ship according to claim 26, wherein said upper deck (130) is provided at a height above the weather deck (23, 23') of between 20% and 200% of the moulded depth of the ship (20) measured to the weather deck (23, 23').

29. A transport ship according to claim 26, wherein the insulated walls (132, 133) extending in the transverse direction directly adjoin the hold section (28, 28') in the front and rear part (25, 35) of the ship.

30. A transport ship according to claim 26, wherein the thermally insulated walls extending in the longitudinal direction adjoin the sheathing (22) of the hull.

31. A transport ship according to claim 26, wherein said upper deck (130) is adapted to support a cargo.

32. A transport ship according to claim 26, wherein the navigating bridge (27) of the ship and the premises (26) of the crew are provided on said upper deck (130).

33. A transport ship according to claim 26, wherein the the refrigerated hold section (30) is provided with tween decks (31), and the distance between the tween decks is about 2 m–3 m.

34. A transport ship according to claim 33, wherein the tween decks (31) are constructed as a grating, and the cooling takes place by means of circulating air.

35. A transport ship according to claim 26, wherein the access to the refrigerated hold section (30) is provided in the thermally insulated walls.

36. A transport ship according to claim 26, wherein the thermally insulated walls (132, 133) of the refrigerated hold section (30) are arranged symmetrically about the midship section and the middle-line plane.

37. A transport ship according to claim 26, wherein said access hatches to the hold sections (28, 28') are provided substantially in the entire width of the hold sections (28, 28').

* * * * *